United States Patent [19]

Matsumura

[11] 4,003,205

[45] Jan. 18, 1977

[54] METHOD AND APPARATUS FOR OPERATING A STEAM TURBINE PLANT HAVING FEED WATER HEATERS

[75] Inventor: Jube Matsumura, Hitachi, Japan

[73] Assignee: Hitachi, Ltd., Tokyo, Japan

[22] Filed: Aug. 7, 1975

[21] Appl. No.: 602,723

[30] Foreign Application Priority Data

Aug. 9, 1974 Japan ..... 49-90825

[52] U.S. Cl. ..... 60/646; 60/664; 60/667; 60/678

[51] Int. Cl.[2] ..... F01K 7/38

[58] Field of Search ..... 60/646, 657, 660, 678, 60/664, 665, 667

[56] References Cited

UNITED STATES PATENTS

| | | | |
|---|---|---|---|
| 3,101,595 | 8/1963 | Peters et al. | 60/678 |
| 3,178,891 | 4/1965 | Lawrance et al. | 60/678 X |

*Primary Examiner*—Allen M. Ostrager
*Attorney, Agent, or Firm*—Beall & Jeffery

[57] ABSTRACT

In a steam turbine plant with feed water heaters receiving steam extracted from the turbine to apply in heat exchange with the feed water being supplied to the boiler, the drain water level in the water heaters is monitored so that when the drain level exceeds a predetermined abnormal level, for example due to rupture of the feed water pipes in the feed water heater, steam supplied to the turbine is automatically reduced to runback the load on the turbine, and thereafter the extraction of the steam to the malfunctioning feed water heater from the turbine is stopped and the feed water heater is bypassed with respect to the feed water flowing to the boiler, so that the malfunctioning feed water heater is thus isolated from the turbine plant.

15 Claims, 3 Drawing Figures

METHOD AND APPARATUS FOR OPERATING A STEAM TURBINE PLANT HAVING FEED WATER HEATERS

BACKGROUND OF THE INVENTION

The present invention relates to a load limiting method and apparatus for a steam turbine plant and more particularly relates to a method and apparatus for operating a turbine plant having a malfunctioning feed water heater.

In large steam turbine plants, it is usual to provide a plurality of feed water heaters to obtain a high thermal efficiency of the plant. In such feed water heaters, feed water supplied to the boiler is preheated through heat exchange with steam at a high temperature that is extracted from a turbine. Steam extracted from the turbine condenses and becomes drain water in the feed water heater during the heat exchange. This drain water is discharged to a next adjacent feed water heater located on the upstream side of the feed water heater with respect to the flow of feed water and recirculates to the boiler through a deaerator and a condenser.

Under a normal operating condition, the drain water condenses in the bottom of the feed water heater and is discharged almost at a constant rate by the pressure of the extracted steam and the drain level in the feed water heater is kept almost constant.

In the case where a feed water tube ruptures within the feed water heater, for example due to vibration or corrosion by steam, feed water will discharge from the ruptured point of the feed water tube so that the drain level in the feed water heater rises rapidly to result in an unsatisfactory heat exchange. As a more serious problem, it is possible that the drain water will flow back to the turbine through the steam extraction tube, which results in a corrosion of the turbine.

In a prior art method, a check valve is provided between the turbine and the feed water heater to prevent the backward flow of the drain water to the turbine. However this is not reliable to prevent the backward flow of the drain water, because the valve seat or the valve disc of the check valve often becomes distorted by heat.

It has recently become a practice to positively close the extraction stop valve in order to perfectly isolate the feed water heater from the turbine, which extraction stop valve may be provided between the check valve and the turbine. This will prevent the above mentioned backflow.

It has been revealed, however, that when the feed water heater is perfectly isolated from the turbine, there is a serious problem with respect to the strength of the diaphragms of the turbine. When a turbine is macroscopically seen, it is an aggregate of orifices which consists of diaphragms and blades. It is so designed that the pressure drop of the fluid inside the turbine is induced only, for example, at a nozzle situated on the diaphragm and that no pressure drop arises at the blades. The strength of the diaphragm is designed so as to withstand the pressure difference between the fluid pressures at adjacent stages at the time when the control valve is fully opened under the usual steam extraction conditions. The fluid pressure differences between the adjacent stages are successively superposed substantially in proportion to the amount of steam flowing to the succeeding stages.

Accordingly, when a part of the steam extraction of the turbine, which is operating under the normal steam extraction condition with the control valve kept fully open, is stopped due to the abnormality of the feed water heater as previously stated, the fluid pressure distribution in the turbine changes, and the diaphragm portion that has its pressure drop increased as a result thereof can undergo an excessively pressure difference greater than the designed value. At this time, the strength of the diaphragm portion becomes unsatisfactory.

SUMMARY OF THE INVENTION

In view of the foregoing, it is an object of the present invention to provide an improved method and apparatus for operating a turbine plant with an abnormal condition of the feed water heater without overstressing the turbine. This is accomplished with an improved load limiting method and apparatus.

Briefly stated, the present invention has been made with respect to this point and achieves the protection of the turbine in such a way that the drain level in the feed water heater is monitored and when the drain level in the feed water heater exceeds a predetermined abnormal level, the feed water heater is perfectly isolated from the turbine and the load on the turbine is reduced to a predetermined value.

BRIEF DESCRIPTION OF THE DRAWING

Further objects, features and advantages of the present invention will become more clear from the following detailed description of a preferred embodiment, as shown in the attached drawings, wherein.

DETAILED DESCRIPTION OF THE PREFERRED EMBODIMENT

Figure 1:
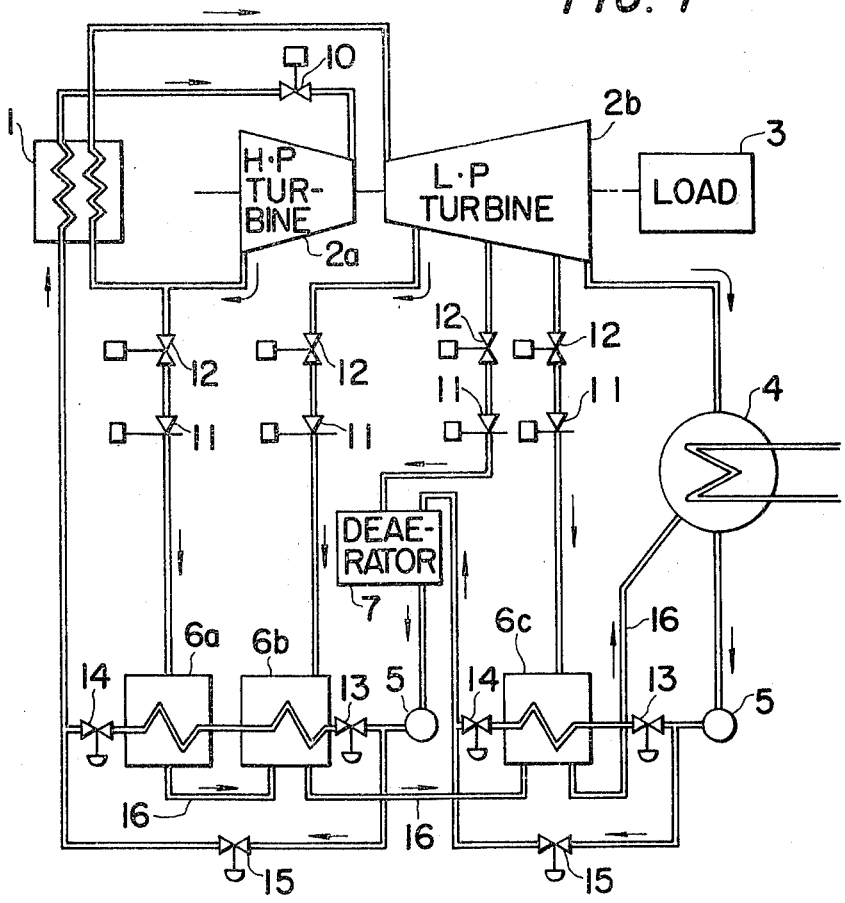
FIG. 1 is a simplified schematic diagram of a steam turbine plant in which the present invention is applied.

The construction of a conventional thermal or nuclear power plant in which the present invention is applied will be stated with reference to FIG. 1, which shows a plant of the reheating and regenerating cycle type. Steam produced in a boiler 1 (a nuclear reactor in case of a nuclear power station) enters a high pressure turbine 2*a* through a steam control valve 10. Steam exhausted from the high pressure turbine 2*a* is reheated in the boiler 1, and thereafter supplied to the low pressure turbine 2*b*. A load three is directly coupled with turbines, 2*a* and 2*b* so as to convert the thermal energy of the steam supplied to the turbine into electrical energy provided as an output for the load 3. The steam exhausted from the low pressure turbine 2*b* is introduced to a condenser 4, where the steam is converted into water. Thereafter, the condensate water from the condenser 4 is recirculated to the boiler 1 by means of a feed water pump 5 through a low pressure water heater 6*c*, a deaerator 7, a feed water pump 5, and intermediate pressure feed water heater 6*b*, and a high pressure feed water heater 6*a*.

The steam passing through the turbine 2*a*, 2*b* is partly extracted. The steam extracted from the high pressure turbine 2*a* is introduced through an extraction stop valve 12 and a check valve 11 to the high pressure feed water heater 6*a*. In the low pressure turbine 2*b*, as illustrated, the steam is extracted at three stages or extraction points. The steam extracted from the first, second and third extraction points is respectively introduced to the intermediate or low pressure feed water heater 6*b*, the deaerator 7, and the low pressure feed water heater 6*c*, with the extracted steam in each case passing through an extraction stop valve 12 and a check valve 11.

The feed water heater 6*c* is provided with a feed water bypass valve 15, a feed water inlet valve 13, and a feed water outlet valve 14; in the example of FIG. 1, two feed water heaters 6*a* and 6*b* are also provided with a feed water inlet valve 13, a feed water outlet valve 14, and a bypass line with a single bypass valve 15. The extracted steam condenses in each of the feed water heaters 6*a*, 6*b*, 6*c* by heat exchange with the feed water supplied to the boiler, and the drain water condensed in the feed water heater is recirculated to the condenser 4 through a water pipe 16. The number and arrangement of the feed water heaters differs in dependence upon the output power of the steam plant and they are not limited to those shown in the drawing.

Figure 2:
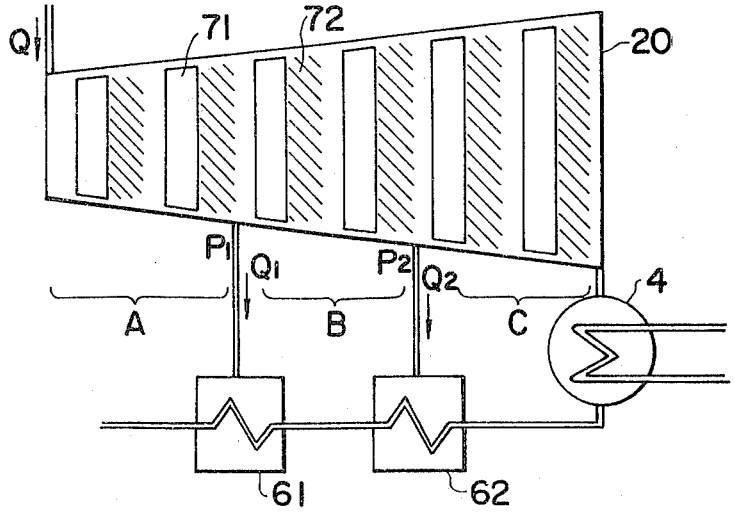
FIG. 2 is a simplified drawing of a turbine with two feed water heaters to explain the principle of the present invention.

Before explaining the preferred embodiment of the present invention, the principle of the present invention will be explained with reference to FIG. 2. In FIG. 2, there is illustrated a simplified drawing of a turbine 20, which comprises turbine diaphragms 71 and turbine blades 72. Q is the steam flow rate supplied to the turbine 20 at the time when the control valve 10 (not shown in FIG. 2, but which is the same as that shown in FIG. 1) is fully opened. Q1 and P1 are respectively the flow rate and pressure at the first stage steam extraction point to be given to the feed water heater 61; similarily Q2 and P2 are respectively the flow rate and the pressure at the second stage steam extraction point to be supplied to the feed water heater 62. Therefore, the flow rates in the respective sections A, B and C are Q, Q − Q1 and Q − Q1 − Q2.

First, when the feed water heater 61 is isolated from the turbine 20, the first stage flow rate Q1 becomes zero. Under normal operating conditions, the amount of steam (Q − Q1 − Q2) discharged into the condenser 4 is overwhelmingly larger in comparison than the total amount of extraction steam (Q1 + Q2), and consequently, even when Q1 becomes zero, the temperature of the fluid at the outlet of the condenser 4 scarcely changes and the amount of steam discharged Q2 is substantially constant. Therefore, the steam flow rate in the section B and C increases, and the amount of increase thereof is the same as Q1. Similarily, the pressures P1 and P2 at the first and second steam extraction points rise. However, if the degree of opening of the control valve 10 is fixed, the fluid pressure at the inlet and outlet of the turbine 20 will remain unchanged. Therefore, pressure drops in the section B and section C become greater than those before the isolation of the feed water heater 61 and diaphragms 71 are thereby overstressed.

On the other hand, when the feed water heater 62 is isolated from the turbine 20 and the second stage extraction steam Q2 becomes zero, feed water which normally would have been heated by the feed water heater 62 is supplied to the feed water heater 61 without being preheated, so that the temperature of the feed water at the inlet of the feed water heater 61 falls down and becomes the same temperature as at the outlet of the condenser 4. Thus, the difference between the temperature of the first stage extraction steam and the feed water increases, and the pressure P1 at the first extraction steam point becomes lower by being cooled by the feed water. Therefore, the amount of steam P1 at the first extraction point increases, with the result that the temperature of the outlet of the feed water heater 61 does not fall down in comparison with that before the isolation of the feed water heater 62. Owing to the increase of the amount of Q1, neither the flow rate between the sections B and C nor the pressure P2 at the second stage steam extraction point changes. Accordingly, when the feed water heater 62 is isolated from the turbine 20, only the pressure P1 becomes lower, whereas the pressure P2 hardly changes. As stated before, if the degree of opening of the control valve is fixed, the fluid pressures at the inlet and outlet of the turbine will remain unchanged. For this reason, a pressure drop in the section A increases and diaphragms in this section will become overstressed.

In view of the above analysis, it is seen that there is a need to protect the turbine, especially the diaphragms, from becoming overstressed when one or a plurality of feed water heaters are abruptly isolated from the turbine.

Figure 3:
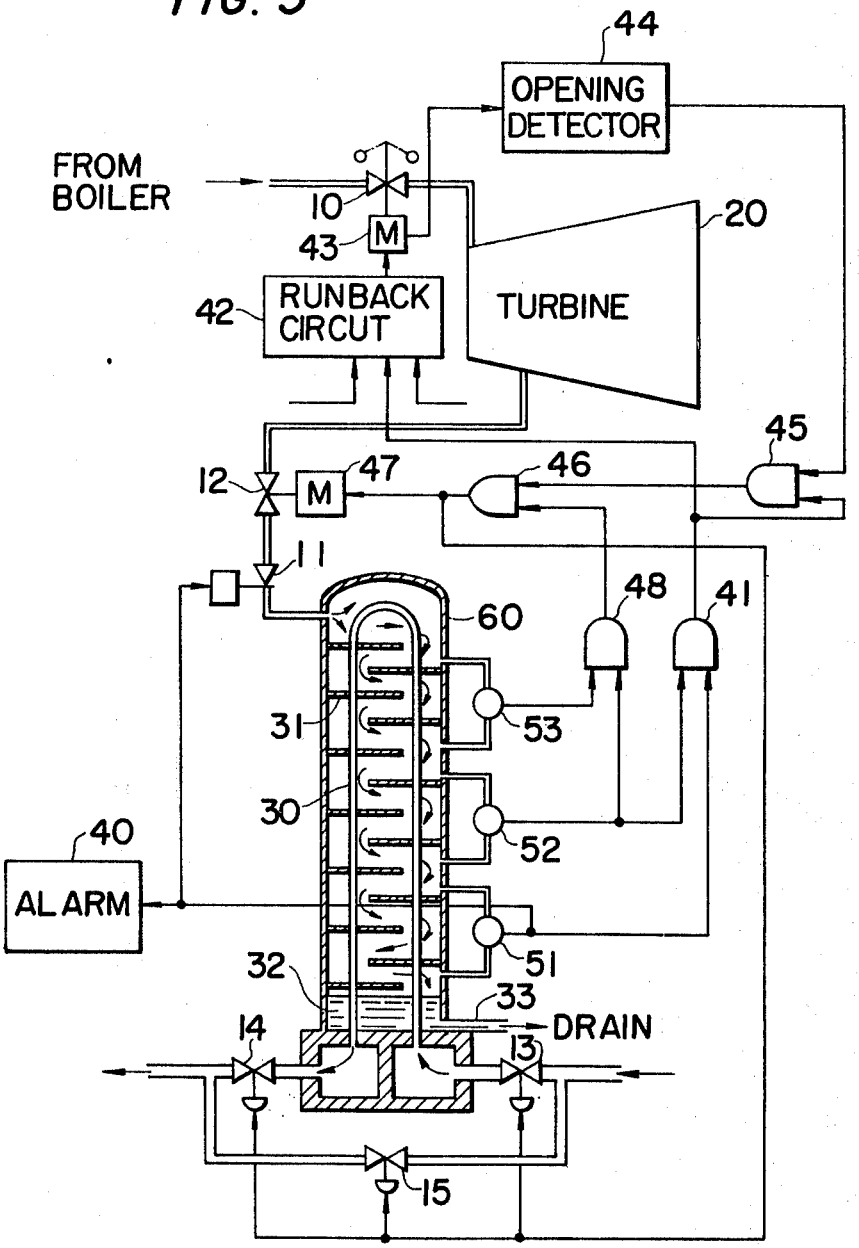
FIG. 3 is a schematic diagram of one embodiment of the present invention.

Referring now to FIG. 3, there is shown one embodiment of the present invention. Under normal operating conditions, the extraction stop valve 12 and the check valve 11 are fully opened, and the extraction steam from the turbine 20 is given to a feed water heater 60. A feed water inlet valve 13 and a feed water outlet valve 14 are opened, whereas a feed water bypass valve 15 is closed. Here, the check valve 11 is a nonreturn valve. That is, the check valve 11 is opened when a pressure in the turbine 20 is higher, and closed when a pressure in the feed water heater 60 is higher. When a signal is supplied to the check valve 11, a force in the closing direction is exerted so that, when the pressure in the feed water heater 60 becomes higher, the quick response to the check valve 11 is obtained. Under an abnormal condition such as the rupture of a heat exchange tube 30 or a blockage which would provide for insufficient exhausting of the drain water, the drain level 32 in the feed water heater 60 will rise to an abnormal extent. When the drain level reaches a first stage level gauge 51, the drain level is detected by the first stage level gauge 51 to produce an output signal indicative of the abnormal condition, which signal is fed to and operates an alarm 40, which may be visible, audible, or the like. The check valve 11 is driven in the closing direction by the same signal being fed to the check valve 11. In addition, this signal is fed to an AND circuit 41. When the drain level further rises and is detected by a second stage level gauge 52, an output signal of the level gauge 52 is fed to a runback circuit 42 through AND circuit 41. The output signal of the second stage level gauge 52 is also fed to an AND circuit 48. Output signals of level gauges of other feed water heaters (not shown) are also fed to the runback circuit 42. This runback circuit 42 calculates the number of feed water heaters that are in the abnormal condition of a high drain level, and the runback circuit 42 determines the degree of the opening of the control valve 10 in accordance with the number of the feed water heaters undergoing the abnormality. Upon this determination, the runback circuit 42 provides a signal to the motor 42, which serves to close the control valve 10 to the degree of opening corresponding to the output signal of the runback circuit 42.

When the control valve 10 is closed to the degree of opening instructed by the runback circuit 42, an opening detector 44, which detects the degree of opening of the control valve 10, provides an output signal. When the runback of the turbine 20 is completed in this manner, the extraction stop valve 12 is closed in response to a signal from the opening detector 44 fed through the AND circuit 45, through the OR circuit 46, and to the motor 47 that will drive the valve 12, to perfectly isolate the feed water heater 60 from the turbine 20. The feed water inlet valve 13 and the feed water inlet valve 14 are closed and the feed water bypass valve 15 is opened by a signal from the OR circuit 46. Thus the feed water heater 60 is removed from the feed water system. Since before the removal of the feed water heater 60 from the system, the runback of the turbine 20 has been completed and the amount of steam supplied to the turbine 20 has thereby been reduced, no diaphragm of the turbine 20 is overstressed by the subsequent closure of the extraction stop valve 12 to terminate the extraction of steam for the affected feed water heater.

As the runback of the turbine is completed by closing the control valve 10, there is a time lag for the completion thereof. In such a case when the drain level rapidly rises above the second stage level gauge 52, a third stage level gauge 53, which is located above the second stage level gauge 52, provides an output signal to the AND circuit 48. Thereby, malfunctioning or abnormal feed water heater 60 may be rapidly isolated from the turbine 20 before the completion of the runback. To this end, the extraction stop valve 20 is closed by the output signal of the third stage level gauge 53 passing through the AND circuit 48 and the OR circuit 46 to the motor 47, to thus isolate the feed water heater 60 from the turbine 20 before the completion of the runback. Further, the valves 13 and 14 are closed and the bypass valve 15 is opened to remove the feed water heater 60 from the feed water system by means of the same signal from the OR circuit 46 that had its source with the level gauge 53, all before the completion of the runback. During and after the signal from the level gauge 53 has completed the disconnection of the feed water heater 60, the runback of the turbine 20 is completed. Since in this case, the disconnection of the troubled feed water heater preceeds the completion of the runback, diaphragms of the turbine 20 are temporarily overstressed until the completion of the runback.

As set forth above in detail, according to the present invention, it is a fundamental rule that when the drain level in the feed water heater reaches a first abnormal level as predetermined, the amount of steam supplied to the turbine is reduced and when the runback of the turbine is completed, the troubled feed water heater is isolated from the turbine. Further, when the drain level in the feed water heater reaches a second abnormal level, which is higher than the first abnormal level, the isolation of the troubled feed water heater is executed without awaiting for the completion of the runback.

In accordance with the present invention, consequently, when the feed water heater is isolated from the turbine, the turbine plant can be stably operated continuously without necessarily overstressing a diaphragm of the turbine.

It is often the case that a plurality of feed water heaters are connected in series and each or plurality of feed water heaters are bypassed through bypass valve 15 as shown in FIG. 1. Accordingly, even when only one of the commonly bypassed feed water heaters becomes troubled and malfunctions, all of the feed water heaters that are connected in series through one bypass valve must be isolated from the turbine at the same time. Therefore, the degree of opening of the control valve 10 is preferably determined dependent upon the number of the feed water heaters connected in series with the troubled feed water heater through one bypass valve. That is, in the case when three feed water heaters are connected in series through one bypass valve, the amount of runback by closing the control valve 10 is determined in correlation with the three heaters even when only one of the three heaters is troubled. In such a situation, the single troubled heater may be immediately isolated from the turbine, and the other heater may continue to function and later be isolated after completion of the runback.

Although a preferred embodiment has been shown and described in detail, the invention may take on other forms, as follows.

Although in FIG. 3, the motor 43 (load limit motor or governor motor) of the control valve 10 is directly driven by the signal from the runback circuit 42, an automatic load adjusting device may be employed and the load applied on the turbine may be adjusted by the signal from the runback circuit 42 to a predetermined value.

In FIG. 3, the completion of the runback of the turbine is detected by detecting the degree of opening of the control valve 10 by the opening detector 44, however a timer may also be employed instead of the opening detector 44 so that the signal that informs the completion of the runback and that is transmitted to the AND circuit 45 may be a signal indicating a predetermined time lag after starting of the runback.

Further in the above description, the load runback is completed before the completion of the isolation of the troubled feed water heater, but it is also possible to simultaneously operate both the isolation of the troubled feed water heater and the runback of the turbine by closing the control valve.

Further modifications, variations and embodiments of the present invention are contemplated according to the broader aspects of the present invention even though the details are important in their own right, all as determined by the spirit and scope of the following claims.

What is claimed is:

1. Rapid load limiting apparatus for a steam turbine plant having a turbine driven by steam from a boiler and feed water heaters in which feed water supplied to the boiler is preheated by steam extracted from the turbine, said apparatus comprising: means for detecting drain water level in the feed water heater, control means for automatically reducing the amount of steam supplied to the turbine when the drain level in the feed water heater reaches an abnormal level and stopping the extraction of steam from the turbine to the feed water heater.

2. The rapid load limiting apparatus of claim 1, further including means for bypassing the supplied feed water past the feed water heater, when the drain level in the feed water heater reaches the abnormal level.

3. The rapid load limiting apparatus of claim 1, wherein said control means comprises first means for detecting a first abnormal level and second means for detecting a second abnormal level which is higher than the first abnormal level in the feed water heater, means for automatically reducing the amount of steam supplied to the turbine to a predetermined amount of steam supplied to the turbine when the drain level in the feed water heater reaches the first abnormal level, first means for stopping the extraction of steam from the turbine to the feed water heater when the reduction of steam supplied to the turbine is completed, and second means for stopping the extraction of steam from the turbine to the feed water heater when the drain level in the feed water heater reaches the second abnormal level.

4. The rapid load limiting apparatus of claim 3 further including means for bypassing the supplied feed water past the feed water heater, when the drain level in the feed water heater reaches both the first and second abnormal levels.

5. The rapid load limiting apparatus of claim 4, wherein said control means further includes third means for detecting a third abnormal level which is lower than the first abnormal level, and said control means further including means for providing an alarm when the drain level in the feed water heater reaches the third abnormal level.

6. In a steam turbine plant having a steam turbine driven by steam obtained by a boiler through a control valve, a feed water heater wherein feed water for the boiler is preheated by steam extracted from the turbine through an extraction stop valve, the improvement comprising in combination rapid load limiting apparatus to insure the safety in an abnormal operating condition of the feed water heater, comprising: a level gauge for detecting the drain water level of extraction steam condensed in the feed water heater, means for closing the control valve to a predetermined degree of opening in accordance with a signal from said level gauge when the drain level in the feed water heater reaches a first abnormal level, means for detecting the degree of opening of the control valve to produce a signal when the control valve is closed to the predetermined degree of opening, means for fully closing the extraction stop valve in accordance with the signal produced in said means for detecting the degree of opening of the control valve, and separately in accordance with a signal produced in said level gauge when the drain level reaches a second abnormal level that is higher than the first abnormal level.

7. The steam turbine plant according to claim 6, further including a plurality of feed water heaters, each having a level gauge for detecting the drain water level of extraction steam condensed in the feed water heater, and said means for closing the control valve determining the number of such feed water heaters having an abnormal drain water level as determined by the signals from said level gauges and correspondingly closing the control valve an amount correlated to such number of abnormally operating feed water heaters.

8. The steam turbine plant of claim 7, further including means for automatically bypassing the feed water around any feed water heater having an abnormal drain water level as determined by said level gauges.

9. The steam turbine plant of claim 6, including means for bypassing the feed water around said feed water heater automatically and simultaneously with the closing of the extraction stop valve.

10. A method for operating a steam turbine plant having steam partially extracted from the turbine to a feed water heater to preheat feed water for a boiler when there occurs an abnormal operating condition of the feed water heater, comprising the steps of: detecting the abnormal operating condition of the feed water heater, running back the load to the turbine from which steam is extracted to the feed water heater, and stopping the extraction of steam supplied to the feed water heater from the turbine.

11. A method for operating a steam turbine of claim 10, further including the step of automatically bypassing the feed water past the abnormally operating feed water heater.

12. A method for operating a steam turbine of claim 10, in which said step of detecting the abnormal operating condition includes a step of monitoring the drain level in the feed water heater, and said step of runbacking the load on the turbine comprising a step of reducing the amount of steam supplied to the turbine connected to the feed water heater.

13. A method for operating a steam turbine of claim 12, wherein said step of detecting the drain level in the feed water heater includes a first step of detecting a first abnormal drain level and a second step of detecting a second abnormal drain level that is higher than the first abnormal drain level, said step of running back occurring when the drain level reaches the first abnormal drain level and reducing the amount of steam supplied to the turbine to a predetermined amount thereof, and said step of stopping occurs when the drain level reaches the second abnormal drain level.

14. A method for operating a steam turbine of claim 13, wherein said step of detecting is automatic and said step of running back automatically occurs in response to said step of detecting when there is an abnormally operating feed water heater, and said step of stopping occurring automatically in response to the detecting of the abnormally operating feed water heater.

15. A method for operating a steam turbine of claim 10, wherein said step of detecting is automatic and said step of running back automatically occurs in response to said step of detecting when there is an abnormally operating feed water heater, and said step of stopping occurring automatically in response to the detecting of the abnormally operating feed water heater.

* * * * *